United States Patent [19]

Kearney

[11] 4,064,418

[45] * Dec. 20, 1977

[54] CONTROLLED ARC STREAM IN HIGH INTENSITY DISCHARGE LAMPS

[75] Inventor: Joseph P. Kearney, Teaneck, N.J.

[73] Assignee: Westinghouse Electric Corporation, Pittsburgh, Pa.

[ * ] Notice: The portion of the term of this patent subsequent to Sept. 13, 1975, has been disclaimed.

[21] Appl. No.: 628,728

[22] Filed: Nov. 4, 1975

[51] Int. Cl.[2] ..... H05B 41/14; H01J 17/14

[52] U.S. Cl. ..... 315/348; 313/154; 313/161; 315/267; 315/338; 315/347

[58] Field of Search ..... 315/267, 338, 343, 344, 315/347, 348; 313/25, 153, 154, 161, 162

[56] References Cited

U.S. PATENT DOCUMENTS

| | | | |
|---|---|---|---|
| 2,030,401 | 2/1936 | Ruff | 315/347 X |
| 2,930,920 | 3/1960 | Bird | 313/161 |
| 3,883,763 | 5/1975 | Kearney | 313/154 |

OTHER PUBLICATIONS

Drop et al., Some Aspects of the Tin Halide Molecular Arc, Lighting Research and Technology, vol. 6, No. 4, 1974, pp. 212–216.

*Primary Examiner*—Eugene R. LaRoche
*Attorney, Agent, or Firm*—W. D. Palmer

[57] ABSTRACT

A discharge lamp with minimized upward bowing of the arc in which conductors carrying full arc current are placed in close proximity above and below the arc tube. The conductors run parallel with the longitudinal axis of the arc tube and the conductors above the arc are electrically connected in such a manner as to carry full lamp current in the opposite direction of the arc, thus repelling the arc in a downward direction, and the conductor or conductors below the arc tube are electrically connected so as to carry full lamp current in the same direction of the arc, thus attracting the arc downward.

4 Claims, 1 Drawing Figure

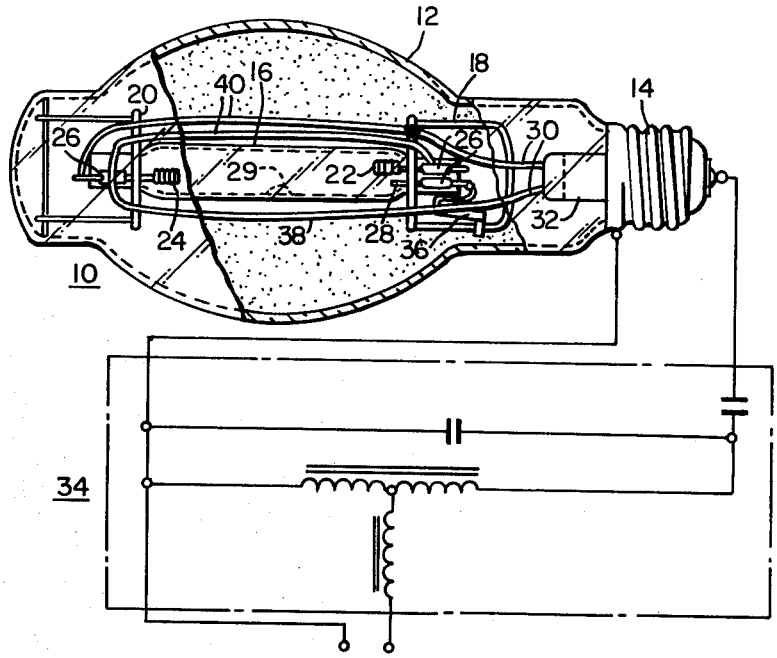
12
18
14
40
16
20
26
26
30
29
22
24
38
28
36
32
10
34

CONTROLLED ARC STREAM IN HIGH INTENSITY DISCHARGE LAMPS

BACKGROUND OF THE INVENTION

The present invention relates to controlling the arc bowing normally encountered in arc discharge lamps. When a discharge lamp is operated with the arc tube in a position other than essentially vertical, and in particular when the arc tube and operating arc are in a horizontal or near horizontal position, the arc discharge does not remain along the central axis of the arc tube during continued operation, but bows upward within the arc tube due to convection. This arc bowing can and often does result in early lamp failure through excessive heating of a particular portion of the arc tube wall.

It is well known that high-pressure mercury-vapor lamps operated at high power levels in a horizontal burning position tend to have a hot portion of the arc tube at the center top section thereof. Electromagnetic means have been used to deflect the arc discharge down into a more central portion within the arc tube by directing the magnetic field transverse to the arc current direction, wherein the interaction of the arc discharge current and magnetic field results in a downward force on the arc.

U.S. Pat. No. 3,562,583, issued to Zollweg and Burnham on Feb. 9, 1971 describes a magnetically rotating, constricted arc discharge device having electromagnetic means to rotate a resultant magnetic flux generally transverse to the arc discharge to cause the arc discharge to rotate about the longitudinal axis of the arc tube and thereby avoid destructive arc bowing.

The use of a separate electromagnet consumes extra power, takes up a great deal of space, and can block a large amount of the light emitted from the arc tube. Permanent magnets can also be used, but they also are bulky and generally block a significant amount of light.

SUMMARY OF THE INVENTION

The present invention provides an inexpensive technique for stabilization of the arc of a gaseous discharge lamp without drawing current in addition to lamp current or blocking a substantial amount of light.

The basic lamp comprises a high-intensity-discharge lamp of the type wherein an elongated arc tube has a main electrode operatively positioned proximate each end, between which electrodes an arc is established during operation and the arc tube is contained within a light transmitting outer envelope. At least three refractory metal conductor portions are located inside of the outer envelope and outside and in close proximity to the arc tube and these conductors run generally parallel to the longitudinal axis of the arc tube and are electrically connected in series with the main electrodes. The conductors are electrically connected such that when the lamp is operated with the arc other than substantially vertical, at least two elongated portions of the conductors are generally above the arc tube and carry full arc current in the opposite direction as the arc and at least one elongated portion of the conductors is generally below the arc tube and carries full arc current in the same direction as the arc. The magnetic effect from the current in both the conductors above the arc tube and the conductors below the arc tube tends to counteract the natural upward bowing of the arc.

BRIEF DESCRIPTION OF THE DRAWING

For a better understanding of the invention, reference may be had to the exemplary embodiment shown in the accompanying drawing in which the sole FIGURE is a side elevational view of a discharge lamp constructed in accordance with the present invention, with parts of the outer envelope broken away.

DESCRIPTION OF THE PREFERRED EMBODIMENT

In the sole FIGURE there is shown the general arrangement of a high-pressure mercury-vapor discharge lamp in which refractory metal conductors in close proximity to the arc tube are used to stabilize the arc. The lamp, generally designated 10, includes an outer light transmitting envelope 12 which is sealed to a mogul base 14. Other types of bases such as a mogul bipost may also be used, as it should be noted that proper predetermined orientation of the refractory metal conductors is essential to proper operation. Mounted within the outer envelope 12, and spaced therefrom, is an arc tube 16. The arc tube 16 is mounted within the outer envelope 12 by a two-piece frame, comprising a base-end frame 18 and a dome-end frame 20. Sealed within the arc tube 16 and disposed at opposite ends thereof are a pair of main electrodes 22 and 24. The base-end main electrode 22 and the dome-end main electrode 24 are connected through the ends of the arc tube 16 by conventional ribbon seals 26. A starting electrode 28 is also connected through the arc tube adjacent to base-end main electrode 22 by means of a ribbon seal 26. In accordance with conventional practices, the arc tube 16 encloses a discharge-sustaining filling such as a charge of mercury 29 and a small charge of inert, ionizable starting gas such as 4 torrs of argon.

A pair of lead-in conductors 30 extend through a conventional re-entrant stem press 32 connected to the mogul base 14, which in turn is connected to a conventional power source through a ballast 34 in a well known manner.

A starting resistor 36 is connected between one of the lead-in conductors 30 and the starting electrode 28.

An elongated portion of refractory metal conductor 38 is positioned below the arc tube 16. Elongated refractory metal conductor portions 40 are positioned above the arc tube 16. One end of the bottom conductor 38 is electrically connected to the one of the lead-in conductors 30 and the other end of the bottom conductor portion 38 is electrically connected to one end of one of the top conductor portions 40. The other end of that same top conductor portion 40 is electrically connected to the base-end main electrode 22. The other top conductor portion 40 is electrically connected on one end to the other lead-in conductor 30 and on the other end to the dome-end main electrode 24.

It will be noted that some lamps of the prior art have used two-piece frames 18, 20 as shown in the FIGURE while others have used one-piece frames. Typically, when one-piece frames are used, the current to the dome-end main electrode is carried through the frame. The instant invention can be used with either one- or two-piece frames, but the two-piece frame, as shown in the FIGURE, is preferred.

Phosphor coatings are commonly used on the interior surface of the outer envelope of high pressure discharge lamps, and, if desired, can be used in conjunction with the present invention. Except for the refractory metal conductors 38, 40 used in the instant invention to counteract the arc bowing, the lamp operation is essentially conventional. A description of the configuration and operation of a conventional high-pressure discharge lamp may be found in U.S. Pat. No. 2,748,303 issued to Thorington on May 29, 1956.

The instant invention permits a gaseous discharge light source to operate in the horizontal mode more efficiently and more safely since it minimizes the natural bowing of the arc stream, which bowing normally causes the arc to come into very close proximity of the wall of the arc tube 16, and sometime actually to touch it. When using this invention, the arc stream is more centrally located, keeping a more uniform temperature. For some types of HID lamps this results in better efficiency. The more central location of the arc prevents violent failure which can be caused by the arc stream coming very close to or actually touching the arc tube 16. Although the invention is intended for use primarily when the arc tube 16 is operated in other than a vertical manner, the invention also assists in stabilizing the arc when the arc tube is vertical.

To provide substantial stabilization, it has been found that the refractory metal conductor portions 38 and 40 should be in close proximity to the arc tube. Generally the conductors should be within a quarter of an inch and preferably within 1/16th of an inch of the arc tube substantially throughout the entire arc length. These conductor portions 38, 40 should be as close as practical to the arc tube 16 and can actually touch the arc tube 16. Because of the temperature on or near the arc tube 16 is quite high, it is necessary to use a refractory metal for such conductors. Suitable refractory metals are tantalum, tungsten or molybdenum, with tungsten preferred. In order to minimize the light blocked by the conductor portions 38, 40 it is also desirable that they be of small diameter. Ribbon conductors can also be used and should be positioned with their larger cross-sectional dimension in radial relationship with the arc such that they provide a minimum shadowing of the light emitted by the arc.

The refractory metal conductor portions 38, 40 are connected in series relationship with each other and in series relationship with the arc path and arc current. This can be achieved in a number of ways. For example, one lead-in conductor 30 can be connected directly to the base-end main electrode 22. The other lead-in conductor 30 is then run over the arc tube 16 and past, but not connected to, the dome-end main electrode 24, back below the arc tube 16 past, but not connected to, the base-end main electrode 22 then over the arc tube 16 back to and connected to the dome-end main electrode 24. In this configuration the three conductor portions 38, 40 can be formed by a single piece of wire.

Another alternative, which is shown in the sole FIGURE, is to run a refractory metal conductor portion 40 from one of the lead-in conductors over the arc tube 16 and connect it to the dome-end main electrode 24. Refractory metal conductor portion 38 is run from the other lead-in conductor 30 below the arc tube 16 past, but not connected to, the dome-end main electrode 24 and then run, as refractory metal conductor portion 40, over the arc tube 16 back to and connected to the base-end main electrode 22. This configuration has the advantage that the refractory metal conductor portions 38, 40 can be conveniently supported by a single additional support at the point at which the conductor is going past, but not connected to, the dome-end main electrode 24.

Such lamps are generally run on AC current and the direction of the current reverses every half cycle both in the arc and in the refractory metal conductors 38, 40. During both halves of the cycle, the current in the bottom refractory metal conductor portion 38 is in the same direction as the arc current and therefore always attracts the arc downward. The currents in the top refractory metal conductor portions 40 are always opposite the arc current and therefore are always tending to repel the arc downward.

Configurations in which more than three conductors are used will function in the mode of the invention although it will be noted that the use of more conductors tends to block more of the light emitted from the arc tube. It can be seen that a five refractory metal conductor configuration in which there are two bottom conductor portions 38 and three top conductor portions 40 can be electrically connected in a manner similar to the aforementioned three refractory metal conductor examples. The two bottom conductor portions 38 and three top conductor portions 40 can be produced by, for example, connecting the base-end main electrode 22 directly to one of the lead-in conductors 30 and running a piece of refractory metal wire, which will form the five refractory metal conductors, from the other lead-in conductor 30 over the arc tube 16, past the dome-end electrode 24, below the arc tube 16, back past the base-end electrode 22, over the arc tube 16 past the dome-end electrode 24, below the arc tube 16 past the base-end electrode 22, and over the arc tube 16 and connecting to the dome-end main electrode 24. It can be seen that even more, i.e. seven, refractory metal conductors can be used in a similar manner.

While lamps can be fabricated with a single refractory metal conductor close to and below the arc tube, experiments have shown that such a configuration is unsatisfactory as it does not provide adequate control of arc bowing.

The instant invention can be used with high-pressure mercury lamps and with metal halide HID lamps. It should be noted however that sodium containing lamps when used with the instant invention will generally experience increased photo-electric problems due to the close proximity of the conductors to the arc tube. The photo-electric problems can be compensated for by placing quartz or ceramic sleeves about the lead-in conductor portions 38 and 40. The instant invention provides a cheaper and more convenient configuration than units in which magnets are used.

I claim:

1. In combination with a high-intensity discharge lamp comprising an elongated arc tube having electrodes operatively positioned proximate the ends thereof and enclosing a discharge-sustaining filling, the spacing between said electrodes within said arc tube defining an arc path along which an operating arc is adapted to be maintained during operation of said lamp, a light-transmitting envelope surrounding said arc tube, electrical lead-in conductors sealed through said surrounding envelope and said arc tube and electrically connected to said electrodes, and said lamp adapted to be operated with said arc tube other than substantially vertical, the improvement which comprises:

said lead-in conductors formed of refractory metal and positioned inside of said surrounding envelope and outside and in close proximity to said arc tube, and said lead-in conductors electrically connected in series circuit with said arc path; and when said lamp is operated with said arc tube other than substantially vertical, at least one elongated portion of said lead-in conductors is located below said arc tube and electrically connected to carry current in a direction the same as the current in said operating arc, and at least two elongated portions of said lead-in conductors are positioned above said arc tube and electrically connected to carry current in a direction opposite to the current in said operating arc; whereby the magnetic effect from the current in both the conductor portions above the arc tube and the conductor portion below the arc tube tends to counteract the natural upward bowing of the operating arc.

2. The lamp of claim 1, wherein three refractory metal conductor portions are used.

3. The lamp of claim 1, wherein said refractory metal is selected from the group consisting of tantalum, tungsten, and molybdenum.

4. The lamp of claim 3, wherein said refractory metal is tungsten.

* * * * *